United States Patent [19]

Ross

[11] 4,255,362

[45] Mar. 10, 1981

[54] ACCELERATOR PUMP CONTROL APPARATUS

[75] Inventor: Gray E. D. Ross, Stanmore, England

[73] Assignee: The Zenith Carburetter Company Limited, Stanmore, England

[21] Appl. No.: 17,592

[22] Filed: Mar. 5, 1979

[30] Foreign Application Priority Data

Mar. 9, 1978 [GB] United Kingdom ..... 9467/78

[51] Int. Cl.[3] ..... F02M 7/08

[52] U.S. Cl. ..... 261/34 B; 261/34 A; 261/39 D

[58] Field of Search ..... 261/34 B, 34 A, 39 D, 261/39 A

[56] References Cited

U.S. PATENT DOCUMENTS

| | | | |
|---|---|---|---|
| 2,145,672 | 1/1939 | Udale | 261/34 B |
| 2,355,346 | 8/1944 | Weber | 261/34 B |
| 2,551,719 | 5/1951 | Ball | 261/34 A |
| 2,879,047 | 3/1959 | Wagner | 261/34 B |
| 3,886,240 | 5/1975 | Baldin et al. | 261/34 B |
| 4,105,719 | 8/1978 | Saito et al. | 261/34 B |
| 4,192,277 | 3/1980 | Ross | 261/39 D |

FOREIGN PATENT DOCUMENTS

| | | | |
|---|---|---|---|
| 2908783 | 9/1979 | Fed. Rep. of Germany | 261/34 B |

*Primary Examiner*—Tim R. Miles

*Attorney, Agent, or Firm*—Stevens, Davis, Miller & Mosher

[57] ABSTRACT

An acceleration pump used in conjunction with an automatic cold start air-fuel mixture supply device, comprising a suction-operated diaphragm, and pressure regulating valve means controlling the communication of engine suction to such diaphragm, movement of such valve means being controlled both by thermostatic means responsive to engine temperature and by a control beam responsive to diaphragm movement.

28 Claims, 7 Drawing Figures

ACCELERATOR PUMP CONTROL APPARATUS

This is a continuation of application Ser. No. 624,623 filed 10-22-75 now abandoned which in turn is a continuation of U.S. Ser. No. 367,291 filed June 5, 1973, now abandoned.

This invention relates to the kind of fuel pump which is for incorporation into an i.c. engine air/fuel induction system which includes a carburetter having a driver operable throttle valve as well, the pump being adapted so that, when used, it operates to pump fuel into the air/fuel induction system when the depression in the inlet manifold of the engine falls below that which is established there when the engine is not loaded and is idling so that the metered supply of air/fuel mixture fed to the engine is augmented automatically by a supply of additional fuel from the fuel pump when the carburetter throttle valve is opened to accelerate the engine. Such a fuel pump is known as an acceleration pump.

One kind of acceleration pump which has been proposed comprises a fuel chamber which has a movable wall which is adapted to be subjected to the depression established in the inlet manifold of the engine when the pump is in use and the engine to which it is fitted is running, so that the movable wall is moved to enlarge the volume of the fuel chamber and to draw liquid fuel into that fuel chamber when the depression in the inlet manifold increases and so that the movable wall is moved in the opposite direction in response to a reduction in that depression so that the volume of the fuel chamber is reduced and liquid fuel is displaced from the fuel chamber into the air/fuel induction system. Such an acceleration pump will be referred to below as an "acceleration pump of the kind referred to above".

It has been proposed that an acceleration pump of the kind referred to above be used in an i.c. engine air/fuel induction system which includes an automatic cold start air/fuel mixture supply device in addition to the carburetter, the automatic cold start air/fuel mixture supply device being of the kind which is adapted to reduce the amount and to change the constitution of the air/fuel mixture it supplies to the inlet manifold of the engine firstly at the end of the engine cranking period, when the engine begins to run under its own power, and then progressively as the engine warms up to its normal working temperature at which there is no need for extra fuel or air to be supplied by the cold start device.

It has also been proposed that an acceleration pump of the kind referred to above be provided with a movable stop which co-operates with the movable wall to limit movement of the movable wall to enlarge the volume of the fuel chamber, and thermostatically controlled means which are linked to the movable stop and which are adapted to control the location of the movable stop in accordance with the temperature of an engine to which the pump is fitted when used, the thermostatically controlled means being adapted to move the movable stop towards the fuel chamber as the temperature of the engine increases when the pump is in use so that the amount by which the volume of the fuel chamber can be increased by the action of the depression to which the movable wall is subjected is reduced as the temperature of the engine increases, but the load to which the movable wall can be subjected due to the pressure differential across it under certain engine operating, such as the so-called "overrun" conditions referred to above, can exceed the opposing load exerted upon the movable stop by the thermostatically controlled means with resultant undesirable consequences.

One object of this invention is to provide a fuel pump for incorporation in an i.c. engine air/fuel induction system which has a driver operable throttle valve as well, and thermostatically controlled means which are operable to modulate the performance of the fuel pump so that the amount of fuel that can be pumped into the induction system by the fuel pump when in use reduced progressively as the temperature of the engine to which it is fitted increases whilst enabling avoidance of the risk that the functioning of the thermostatically controlled means might be influenced undesirably by the action of depressions in the inlet manifold of the engine that are higher than the depression that is established in the inlet manifold of the engine when the engine is not loaded and is idling.

This object is achieved in broad terms by providing a fuel pump for incorporation in an i.c. engine air/fuel induction system which includes a carburetter having a driver operable throttle valve as well, the fuel pump comprising a hollow casing, a movable wall which divides the interior of the hollow casing into an air chamber and a fuel chamber, which is for connection to a source of liquid fuel and the air/fuel induction system, resilient means which urge the movable wall to minimise the volume of the fuel chamber and pressure regulating means for regulating the depression in said air chamber in accordance with a function of the depression that is established in the inlet manifold of the engine to which the pump is fitted when used and to the temperature of that engine, the pressure regulating means including a valve which is associated with thermostatically controlled means which are adapted to be responsive to the temperature of the engine to which the pump is fitted when used, the valve being adapted to be urged to restrict communication between the air chamber and the inlet manifold of the engine in response to a tendency for the depression in said chamber to exceed a predetermined maximum when said predetermined maximum depression acts within the air chamber and the depression in the inlet manifold of the engine is at or above said predetermined maximum whilst, at least when the temperature of the engine is less than the normal working temperature, permitting relatively free communication between the air chamber and the inlet manifold of the engine when the depression in the inlet manifold of the engine is less than said predetermined maximum, the thermostatically controlled means co-operating with the valve and with an air bleed into the air chamber such that the volume of the air chamber, when communication between the reference pressure chamber and the inlet manifold is restricted, increases as the temperature of the engine increases.

Preferably the valve is adapted to be seated by the thermostatically controlled means to shut off communication between the air chamber and the inlet manifold of the engine when the engine has warmed up to its normal working temperature.

The preferred arrangement of pressure regulating means comprise a suction port in the air chamber, the suction port being for connection to the inlet manifold of the engine to which the pump is fitted when used; means for providing a regulated air flow into the air chamber from a separate source which is at a pressure which is higher than that in the air chamber, the regulated air flow comprising said air bleed, and a control member which extends movably through a wall portion of the casing into the air chamber and which is adapted to be linked to said thermostatically controlled means which are operable to move the control member relative to the casing when the temperature of the engine changes so that the location of the control member relative to the casing is dependent upon the temperature of the engine; said valve comprising a shut-off valve for the suction port, said valve being resiliently biassed open and co-operating with a control beam which is pivotally connected to the control member which has a portion which c0-operates with the movable wall so that it follows movement of the movable wall, the suction port shut-off valve and the control beam being orientated with respect to the movable wall and the suction port such that the suction port shut-off valve is moved in the closing direction by movement of the control beam that follows movement of said movable wall to enlarge the volume of the fuel chamber; and the forces that act upon the suction port shut-off valve to tend to seat it when the pump is in use, once it is located adjacent the suction port to restrict flow through the suction port and limit further increase in the volume of the fuel chamber, comprising a reaction applied to it from the control beam and the action upon it of the depression in the suction port and the forces tending to move it away from the suction port comprising the biassing load by which it is biassed open and the action upon it of the depression that is established within the air chamber.

Preferably the means for providing a regulated air flow into the air chamber provide such an air flow continuously and comprise a passage of restricted dimensions which is formed in the casing and by which the air chamber is placed in restricted communication with the surrounding atmosphere which comprises said separate source of air. Conveniently the restricted passage comprises the clearance between the control member and a bore in said casing wall portion within which that control member is a sliding fit.

The suction port shut-off valve may be a needle valve which is urged into abutment with the control beam by a coil spring which reacts against the casing around the suction port and serves as the biassing means by which said valve is biassed open.

Conveniently the control beam portion that co-operates with the movable wall comprises a lobe which abuts the movable wall and which is profiled so that it maintains contact with the movable wall during rocking movement of the control beam relative to the movable wall. The control beam may have two such lobes each formed by a respective one of two bowed limbs which extend on either side of said resilient means, the bowed limbs being joined together by bridge pieces adjacent their ends on either side of said resilient means.

Conveniently the pivotal connection between the control member and the control beam is adjacent to one of the bridge pieces and the needle valve is urged into abutment with the other bridge piece which is flat.

In one embodiment the pivotal connection between the control member and the control beam comprises at least one substantially V-shaped part which is carried by the control member and which is engaged in the manner of a knife edge in a corresponding notch formed in the control beam. The at least one substantially V-shaped part may be one of two such V-shaped parts which are carried by the control member in the manner of trunnions and which each rest in a respective notch which is formed by a respective one of the bowed limbs.

Conveniently the V-shaped parts are formed by a body which has a through bore through which the control member extends, the body being urged onto a stop carried below it by the control member and being so urged by resilient means which react against an abutment carried above it by the control member. The stop may comprise a self-locking nut fitted onto the control member. The preferred form of self-locking nut comprises a U-shaped component bent up from sheet material with an aligned pair of holes formed in each of its two sheet material limbs, the control member having a screw-threaded portion which is screwed into the aligned pair of holes and the limbs being deflected from the relative locations to which they are urged by the inherent resilience of the component.

Preferably the movable wall is a diaphragm of flexible impervious material.

Preferably at least that part of the diaphragm that extends across the interior of the hollow casing to separate the air chamber from the fuel chamber is a non-apertured sheet of the flexible impervious material, which is better able to withstand the pressure differential that is applied to it when the pump is being used. Conveniently the movable wall includes a disc which is within the air chamber, which is urged against the diaphragm by the resilient means and which is abutted by the or each bowed limb of the control beam. Preferably a major part of the diaphragm, including its central portion, is adapted to seat upon the opposed wall of the fuel chamber so that the volume of that fuel chamber is negligible when it is minimised. Hence virtually no fuel is contained within the fuel chamber when the pump is not being used nor when the temperature of the engine to which the pump is fitted when used has reached the normal working temperature of that engine. Consequently fresh fuel is drawn into the fuel chamber whenever the fuel pump is operated.

The fuel chamber may have a single port through which fuel is both drawn into the fuel chamber and discharged from the fuel chamber. The fuel chamber port may be in communication with a conduit length of flow restricting dimensions.

According to another aspect of this invention there is provided the combination of a cold start fuel/air mixture supply device and a fuel pump for incorporation in an internal combustion engine fuel induction system which includes a carburettor having a driver operable throttle valve as well, the cold start fuel/air mixture supply device comprising an air supply passage which has one end for connection to the inlet manifold of the internal combustion engine so that air can be drawn through that passage by engine suction when the device is fitted to the engine, an automatically operable throttle valve in the air supply passage, the automatically operable throttle valve being adapted to co-operate with an orifice which is formed within the air supply passage in order to throttle fluid-flow through that orifice and being arranged to be urged to reduce the effective area of the orifice by engine suction when the device is fitted to the engine and the engine is running under its own power a fuel passage which terminates in a fuel discharge nozzle which is formed in the air supply passage upstream of the orifice, the fuel passage including fuel metering means for metering flow of fuel drawn through the fuel passage from a source of liquid fuel by a depression which is established within part of the air supply passage upstream of the orifice, and thermostatically controlled means comprising a movable stop for limiting movement of the automatically operable throttle valve in the direction in which it is moved to reduce the effective area of the orifice, the position of the stop being controlled automatically in relation to the temperature of the engine to which the cold start fuel/air mixture device is fitted when used by control means which are responsive to the temperature of the engine in use so that the stop is moved to allow following movement of the automatically operable throttle valve in said direction as the engine warms up towards its normal working temperature whereat movement of said automatically operable throttle valve to close the orifice is permitted, whereby, when the device is fitted to the engine the constitution of the air/fuel mixture drawn from the device by the engine is changed firstly at the end of the engine cranking period, when the engine begins to run under its own power, and, when the engine has started to run under its own power, both the air flow in the air supply passage and the flow of fuel into the air supply passage through the fuel passage are decreased progressively with increase in engine temperature; and the fuel pump comprising a hollow casing, a movable wall which divides the interior of the hollow casing into an air chamber and a fuel chamber which is for connection to a source of liquid fuel and the air/fuel induction system, resilient means which urge the movable wall to minimise the volume of the fuel chamber and pressure regulating means for regulating the depression in said air chamber in accordance with a function of the depression that is established in the inlet manifold of the engine to which the pump is fitted when used and to the temperature of that engine, the pressure regulating means including a valve which is associated with thermostatically controlled means which are adapted to be responsive to the temperature of the engine to which the pump is fitted when used, the valve of the pressure regulating means being adapted to be urged to restrict communication between the air chamber and the inlet manifold of the engine in response to a tendency for the depression in said air chamber to exceed a predetermined maximum when said maximum depression acts within the air chamber and the depression in the inlet manifold of the engine is at or above said predetermined maximum whilst, at least when the temperature of the engine is less than the normal working temperature, permitting relatively free communication between the air chamber and the inlet manifold of the engine when the depression in the inlet manifold of the engine is less than said predetermined maximum so that fuel is displaced from the fuel chamber into the air/fuel induction system when the depression established in the inlet manifold of the engine is at or below the predetermined maximum and that depression falls and fuel is drawn into the fuel chamber from said source when the depression established in the inlet manifold of the engine increases up to said predetermined maximum, the thermostatically controlled means that are associated with the valve of the pressure regulating means co-operating with that valve and with an air bleed into the air chamber such that the volume of the air chamber, when communication between the air chamber and the inlet manifold is restricted, increases as the temperature of the engine increases.

Preferably the cold start fuel/air mixture supply device includes an air valve which co-operates with a valve seat to vary the area of part of the air supply passage upstream of the orifice and thereby controls the depression that is established within that portion of the air supply passage between the orifice and the valve seat, which is the portion of the air supply passage in which the fuel discharge nozzle is formed, and that serves as the fuel demand signal that draws fuel into the passage from the source of liquid fuel, and yieldable biassing means for urging the air valve towards the valve seat against the action upon the air valve of any such depression which is established within the air supply passage between the valve seat and the orifice and which tends to unseat the air valve. The preferred form of air valve carries a part which has a surface which is exposed to the pressure that is existent in a space which is for connection to a suitable source of suction, such as the inlet manifold of the engine, the part and the space being orientated with reference to the yieldable biassing means and said air valve seat so that, when the device is fitted to the engine in use, the biassing effect of said yieldable biassing means upon said air valve is opposed by the thrust due to the action on said surface of suction from said source, the arrangement being such that the effective cross-sectional area of said part of the air supply passage is dependent upon the depression that is established within the air supply passage between the orifice and the valve seat, upon the biassing effect exerted upon the air valve by the yieldable biassing means and upon the opposing thrust exerted upon the air valve due to the action on said surface of suction from said source.

Conveniently the fuel chamber is connected to the fuel passage of the cold start fuel/air mixture supply device upstream of the fuel metering means so that it is adapted to be connected to the same source of liquid fuel as is that fuel passage and so that fuel displaced from the fuel chamber is fed into the air/fuel induction system through the fuel metering means of the cold start fuel/air mixture supply device. The fuel pump may be adapted to be rendered inoperative to pump liquid fuel into the air/fuel induction system when the engine with which the combination is used has warmed up to the temperature at which the cold start fuel/air mixture supply device ceases to supply extra fuel and air to the engine. Alternatively, particularly where the carburetter is a fixed choke carburetter, the fuel pump may be connected to a suitable other location in the air/fuel induction system remote from the cold start device and may be adapted to continue to function to pump extra fuel into the air/fuel induction system of an engine with which the combination is used when the depression in the inlet manifold of that engine falls and the engine has warmed up to its normal working temperature.

It is desirable to arrange for the volume of the fuel chamber of an acceleration pump of the kind referred to above to be maximised by the action upon the movable wall of the depression that is established in the inlet manifold of the engine when the engine is not loaded and is idling so that it will contain the required volume of fuel for injection into the air/fuel induction system when required to do so; but there are certain engine operating conditions that can occur, for example the so-called "overrun" conditions when the engine is acting as a brake, when the depression in the inlet manifold will be higher than that that is established there when the engine is not loaded and is idling. If the movable wall is a diaphragm of flexible impervious material, which is the most convenient form of movable wall for this purpose known today, its material is liable to be strained by the action upon it of such a higher depression to which it will be subjected and such strain can lead to deformation of the material of the diaphragm, so that the diaphragm is liable to flex and displace liquid from the fuel chamber when such fuel displacement is undesirable, or can lead to rupture of the material of the diaphragm.

Accordingly another object of this invention is to provide a fuel pump which is suitable for incorporation into an i.c. engine air/fuel induction system which includes an automatic cold start fuel/air mixture supply device of the kind described above and a carburetter having a driver operable throttle valve as well, the fuel pump being adapted to respond to opening of the driver operable throttle valve by displacing liquid fuel from its fuel chamber into the air/fuel induction system but which is less liable to be operated unintentionally or damaged by the effects of higher depressions that can be established in the inlet manifold during certain operating conditions of the engine.

According to a further aspect of this invention there is provided a fuel pump for incorporation in an i.c. engine air/fuel induction system which includes a carburetter having a driver operable throttle valve as well; the fuel pump comprising a hollow casing, a diaphragm of flexible impervious material which divides the interior of the hollow casing into an air chamber and a fuel chamber, resilient means which urge the diaphragm to minimise the volume of the fuel chamber, the air chamber having a suction port which is for connection to the inlet manifold of the engine to which the pump is fitted when used, and a valve for the suction port which is resiliently biassed open and which co-operates with a control beam which has a portion which co-operates with the diaphragm so that the beam follows movement of the diaphragm, the suction port valve and the control beam being orientated with respect to the diaphragm and the suction port such that the suction port valve is urged towards the suction port by movement of the control beam that follows movement of said diaphragm to enlarge the volume of the fuel chamber, the arrangement being such that, once the suction port valve reaches a location relative to the suction port in which it restricts flow through the suction port so that the pressure in the air chamber is maintained substantially constant and further increase in the volume of the fuel chamber is prevented, the forces acting upon it to urge it towards the suction port comprise a reaction applied to it from the control beam and the action upon it of the depression in the suction port and the forces tending to move it away from the suction port comprise the biassing load by which it is biassed open and the action upon it of the depression that is established within the air chamber.

One embodiment of this invention will be described now by way of example with reference to the accompanying drawings of which:

Figure 1:
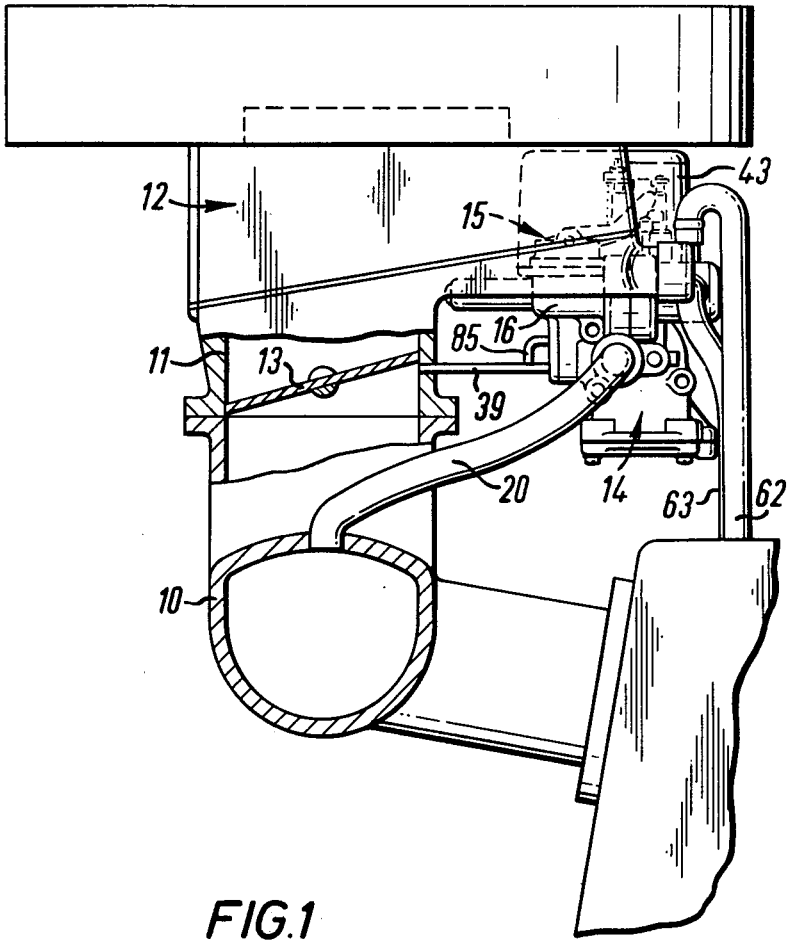
FIG. 1 is a partly sectioned elevation of an air/fuel induction system for a spark ignition internal combustion engine, the system including a carburetter, a cold start fuel/air mixture supply device, and a fuel pump.

FIG. 1 illustrates a spark ignition internal combustion engine installation for a motor vehicle which includes an air/fuel induction system which comprises an engine inlet manifold 10 to which the induction passage 11 of a carburetter 12 is connected. The driver operable throttle valve of the carburetter is indicated at 13.

The air/fuel induction system also includes a fuel pump 14 and a fully automatic cold start fuel/air mixture supply device 15 which are housed in a single body 16 which is mounted on the body of the carburetter 12.

Figure 3:
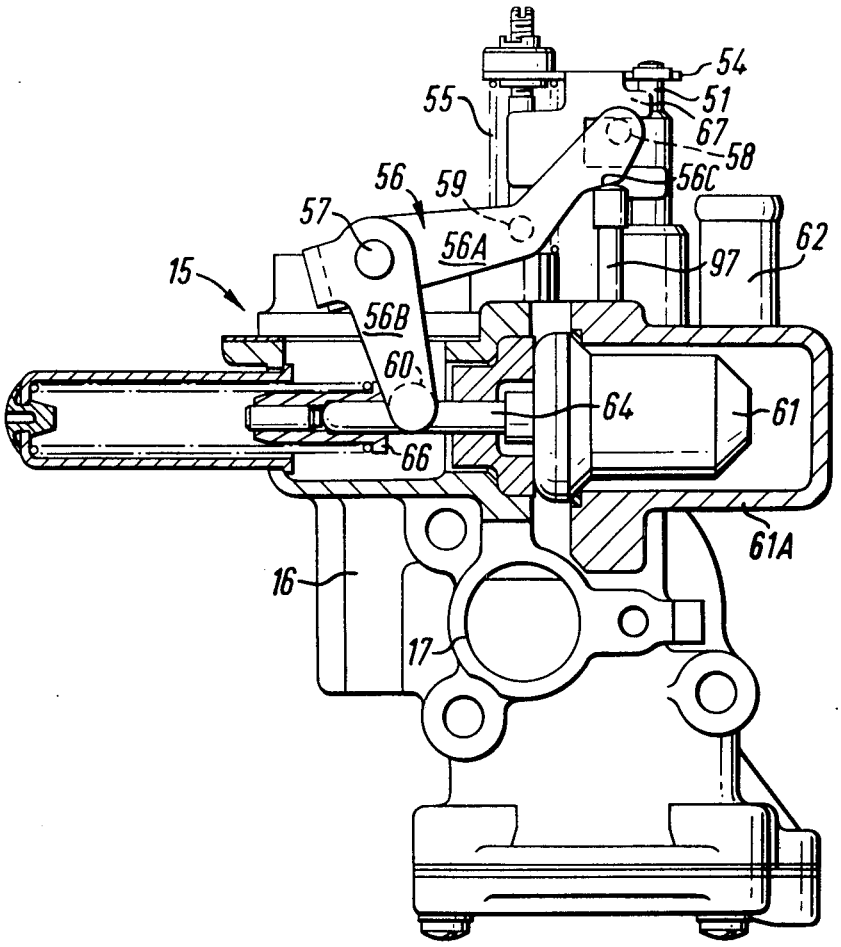
FIG. 3 is a section on the line III—III of FIG. 2 with the various parts of the device shown in the positions they adopt when the engine is cold and idling.
Figure 4:
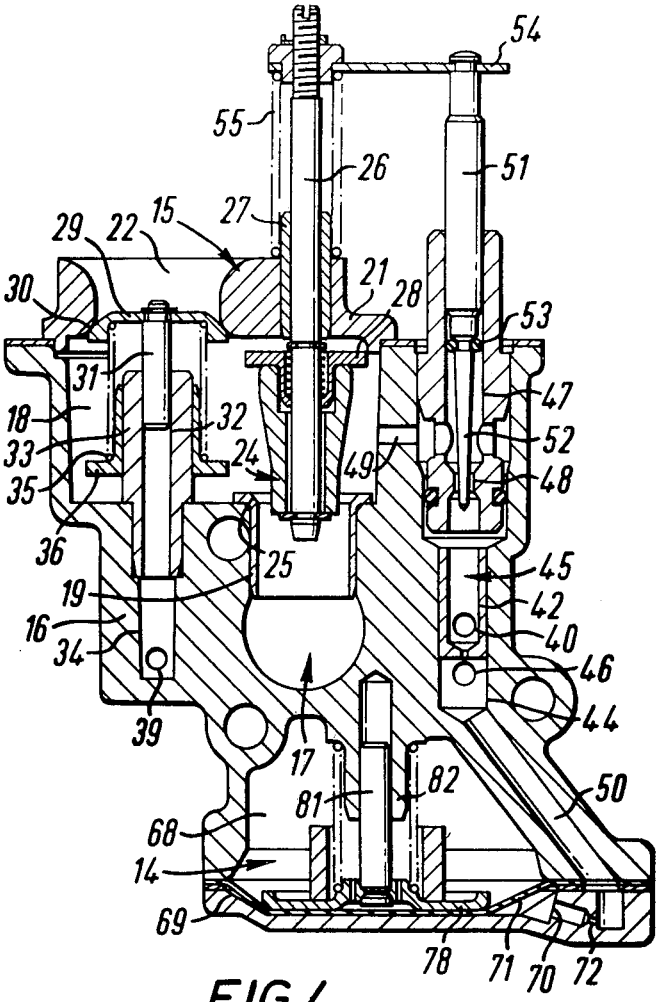
FIG. 4 is a section on the line IV—IV of FIG. 2 with the various parts of the device shown in the positions they adopt when the engine is cold and not running.

The cold start device 15 comprises a through passage 17 formed in the body 16 (see FIGS. 3 and 4). The through passage 17 comprises a chamber 18 and a downstream passage portion 19 which has a smaller cross-section than does the chamber 18. The downstream end of the downstream passage portion 19 is connected to the induction passage 11 of the carburetter 12 downstream of the driver operable throttle valve 13 via a pipe 20 (see FIG. 1).

Figure 2:
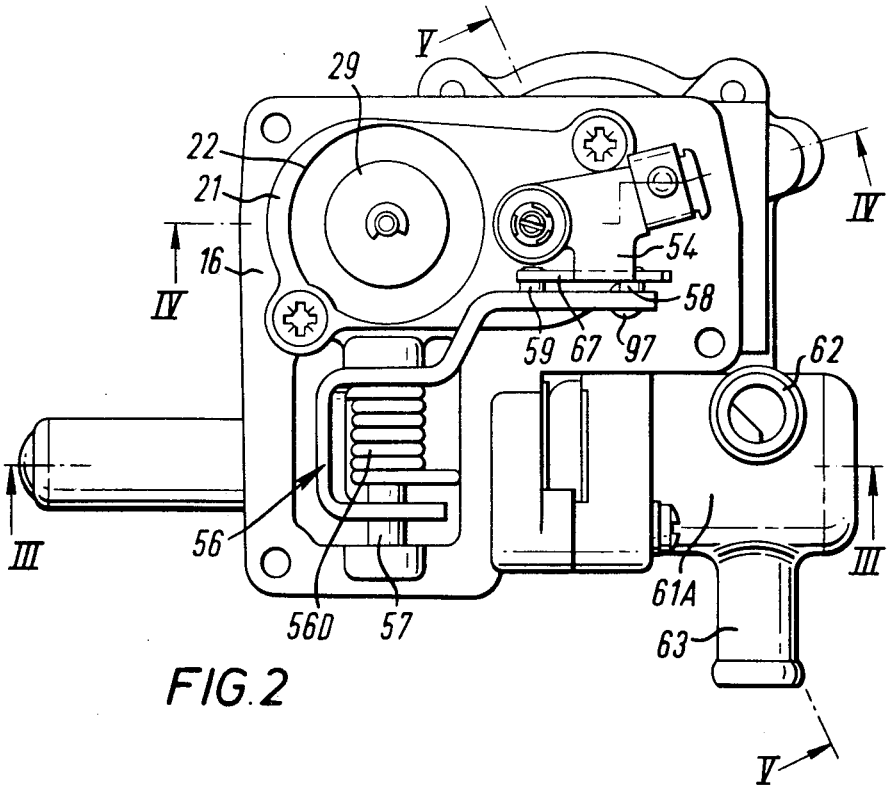
FIG. 2 is a plan view of the cold start fuel/air mixture supply device of the system shown in FIG. 1 with its cover removed.

FIGS. 2 and 4 show that the chamber 18 is closed at its upstream end by a closure plate 21 which has an aperture 22 formed in it. The aperture 22 is displaced laterally with respect to the junction of the chamber 18 and the downstream passage portion 19.

A profiled plug valve 24 co-operates with the orifice 25 that is formed at the junction of the chamber 18 and the downstream passage portion 19 in order to control fluid flow from the chamber 18 to the downstream passage portion 19. The plug valve 24 is carried by a rod 26 which is guided for rectilinear movement along its axis by being engaged slidably within a tubular guide 27 which is integral with the closure plate 21. An annular plate valve 28 is also carried by the rod 26 and is adapted to seat around the orifice 25 to close the through passage 17 when the engine has warmed up to its normal operating temperature. The Complete Specification of our British Patent Application No. 53180/76 includes a full description of the detailed construction and arrangement of the plug valve 24, the orifice 25, the rod 26 and the annular plate valve 28.

A rectilinearly movable air valve 29 co-operates with a valve seat 30 to close the aperture 22. The air valve 29 has a coaxial cylindrical guide stem 31 which is engaged for sliding movement within the bore 32 of a tubular insert 33 which has one end spigotted into a blind bore 34 which is formed in the body 16. The remainder of the tubular insert 33 projects from the bore 34 into the chamber 18. A coil spring 35 reacts against the flange of a flanged tubular abutment member 36 which is mounted slidably upon that part of the insert 33 that projects into the chamber 18, and biasses the air valve 29 to seat on its seat 30. The abutment member 36 is located by abutment with the end of an adjuster screw (not shown) which is screwed into the body 16. The closed inner end of the blind bore 34 is connected to the induction passage 11 of the carburetter 12 just downstream of the driver operable throttle valve 13 by a short pipe 39. The Complete Specification filed in connection with our Patent Application No. 40005/74 includes a full description of the detailed construction and arrangement of the air valve 29, the guide stem 31 and the coil spring 35.

The axes of the guide stem 31 and the blind bore 34 are parallel to the axis of the plug valve rod 26 and are coincident with the axes of the air valve 29 and the annular valve seat 30. All the axes are vertical, the stem 31 depending from the air valve 29 which is supported by the coil spring 35. Normally the air valve 29 controls communication between the chamber 18 and an enclosure defined between the body 16 and a cup-shaped cover 43 (see FIG. 1). The cover 43 has an inlet port which is connected to the upstream end of the induction passage 11 of the carburetter 12.

Another through passage 45, which is formed within the body 16, has a stepped main bore portion which is substantially parallel with the axis of the plug valve support rod 26 and a laterally extending end bore portion 46 which is connected at one end to the lower end portion 44 of the stepped main bore and at the other end to the fuel chamber of the carburetter 12. The upper end portion 47 of the stepped main bore portion is in direct communication with the enclosure formed between the body 16 and the cup-shaped cover 43 and is separated from the remainder of the stepped main bore by the smallest diameter portion 48 of the stepped main bore. The end bore portion 47 communicates with the chamber 18 via a passage 49 in the body 16. The upper end of the lower end portion 44 of the stepped main bore communicates with the smallest diameter portion 48 of that stepped main bore via a stepped bore portion 42 and the step formed by that stepped bore portion 42 serves as a valve seat for a ball valve 40. The laterally extending bore portion 46, the lower end bore portion 44, the stepped bore portion 42, the smallest diameter bore portion 48, the upper end bore portion 47 and the passage 49 together comprise a fuel passage and the smallest diameter bore portion 48 comprises a metering orifice for metering fuel flow through the fuel passage to the chamber 18.

A cylindrical member 51 carries a profiled fuel metering needle 52 and slides within the end portion 47 of the stepped through bore. The profiled needle 52 projects through the fuel metering orifice 48 and carries a sealing ring 53 at its largest diameter end which is the end that is attached to the cylindrical member 51. The end of the cylindrical member 51 remote from the profiled needle 52 is coupled to the plug valve support rod 26 by an arm 54 which is fixed at one end to the rod 26 and which extends laterally from it. The plug valve 24 and the fuel metering needle 52, which are coupled together and guided for rectilinear movement along parallel paths, are urged by a coil spring 55 into the respective positions in which the effective cross-sectional areas of the orifices 25 and 48 with which they co-operate are at their greatest.

FIGS. 2 and 3 show a cranked lever 56 which is mounted pivotally on a hinge pin 57. The cranked lever 56 has two limbs 56A and 56B which project from the hinge pin 57 in different directions which are generally mutually perpendicular. The range of angular movement of the lever 56 is of the order of 20° or 30° and the limbs 56A and 56B are arranged so that the limb 56A extends substantially horizontally past the throttle valve biassing coil spring 55 and the limb 56B depends from the hinge pin 57 substantially vertically when the lever 56 is in the middle of its range of angular movement. The limb 56A is cranked. The half of the cranked limb 56A that is further from the hinge pin 57 projects upwards to the outer end of the limb 56A at which a first peg 58 is mounted. The underside of the half of the cranked limb 56A that carries the first peg 58 is recessed to form a downwardly facing edge portion 56C below the first peg 58. A second peg 59 is carried by the limb 56A substantially midway between the edge portion 56C and the hinge pin 57. A third peg 60 is carried by the limb 56B at its lower end. The first peg 58 projects into a recess which is formed in a plate 67 which depends from the arm 54 to which it is fixed. The second peg 59 projects below both the arm 54 and the plate 67.

A temperature sensitive capsule 61 is housed within a water jacket 61A which is mounted on the body 16 and which is connected into the cooling water system of the engine by pipes 62 and 63. The capsule 61 is filled with wax or other suitable substance having a high volumetric thermal expansion. The arrangement is such that, with increase in temperature, the wax or other substance expands and moves an actuator rod 64 along its length aginst the action of a coil spring 65. The actuator rod 64 carries an annular flange 66. The third peg 60 extends between the flange 66 and the capsule 61, the axes of the third peg 60 and the rod 26 being mutually perpendicular.

A torsion spring 56D reacts against the body 16 and acts on the lever 56 to urge the third peg 60 into contact with the flange 66.

The temperature sensitive capsule 61 is sensitive to engine temperature, being responsive to engine water temperature, so that the angular position of the lever 56 is related to the temperature of the engine. The location of the first and second pegs 58 and 59 on the cranked lever 56 is such that, at a selected location of the lever 56 between the extreme ends of its range of angular movement, the vertical distance between the two pegs 58 and 59 equals the height of the recess formed in the plate 67. Hence the vertical distance between the two pegs 58 and 59 is greater than the height of the recess in the plate 67 when the lever 56 is above said selected location, that is when the engine is very cold, and is less than the height of that recess when the engine is warmer and the lever 56 is below said location.

Figure 5:
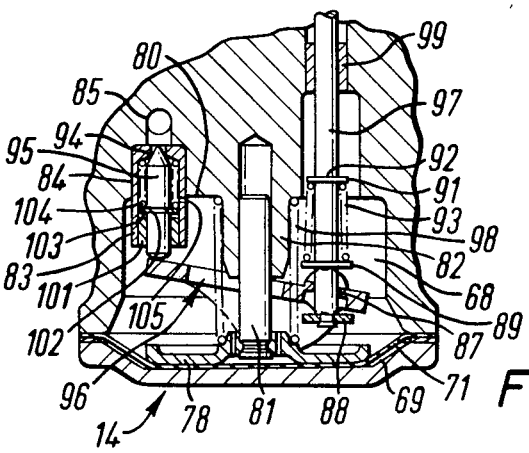
FIG. 5 is a sectioned fragment of the device shown in FIGS. 1 to 3, the section being on the line V—V in FIG. 2, and the various parts being shown in the positions they adopt when the engine is running and has warmed up to its normal operating temperature.

The fuel pump 14 is illustrated in FIGS. 4 and 5 and comprises a cavity which is formed in the body 16. The cavity is divided interiorly into two chambers 68 and 69 by a non-apertured rolling diaphragm 71 of flexible impervious sheet material. The chamber 69 is a fuel chamber and has a port 70 which is connected to the lower end bore portion 44 of the fuel passage of the cold start device 15 by a conduit 50 (see FIG. 4). The conduit 50 has a portion 72 of flow restricting dimensions. Back flow of fuel from the fuel chamber 69 to the fuel chamber of the carburetter 12 is prevented by a suitably located one-way valve (not shown).

A disc 78 is seated on the side of central portion of the rolling diaphragm 71 opposite the fuel chamber 69. A cylindrical stem 81 has its lower end fixed to the disc 78, the remainder of the stem 81 projecting away from the diaphragm 71 across the chamber 68 with its axis substantially normal to the disc 78. The projecting portion of the stem 81 is a sliding fit within the bore of a tubular projection 82 which is formed by that part of the body 16 that forms the fuel pump casing so that it projects into the chamber 68 from the wall 80 of that chamber 68 that faces the diaphragm 71. The tubular projection 82 and the stem 81 are coaxial so that the stem 81 is guided for rectilinear movement by the tubular projection 82.

A tubular body 83 with a stepped bore is spigotted into a bore 84 which is formed in that part of the body 16 that forms the wall 80 of the chamber 68. A small diameter portion of the bore of the tubular body 83 is within the bore 84 and the remainder projects from that bore 84 into the chamber 68. The axis of the tubular body 83 is substantially parallel to the axis of the tubular projection 82. The bore 84 is connected by a conduit 85 to a pipe 39 which is connected to the induction passage 11 just downstream of the driver operable throttle valve 13 (see FIG. 1).

A control beam 96 is located within the other chamber 68. The beam 96 is a moulding of plastics material and comprises a pair of bowed limbs which extend one on either side of the stem 81. The bowed limbs are joined together by bridge pieces on either side of the stem 81. That part of each bowed limb that extends past the stem 81 and bridges the gap between the two bridge pieces has its lower edge formed as a lobe which rests on the disc 78.

A main coil spring 98 in the chamber 68 surrounds the tubular projection 82 and extends through the aperture that is formed in the control beam 96 between its two bridge pieces and between the lobes of its bowed limbs. The main coil spring 98 reacts against the wall 80 and acts through the disc 78 to urge the diaphragm 71 towards the opposite wall of the fuel chamber 69 and thus tends to minimize the volume of the fuel chamber 69. The portion of the body 16 with which the diaphragm 71 co-operates to form the fuel chamber 69 is shaped so that the diaphragm 71 can seat upon the opposite wall of the fuel chamber 69 so that the volume of the fuel chamber 69 becomes negligible. A small annular space remains (as shown in FIG. 5) so that the fuel outlet port 70 is not occluded by the diaphragm 71.

A control rod 97 is a good sliding fit in a bore 99 in the body 16 and projects from that bore 99 into the space formed between the body 16 and the cup-shaped cover 43. The bore 99 extends from the chamber 68 to the upper surface of the body 16 and is aligned with the edge portion 56C of the lever 56. The lower end of the control rod 97 projects through an aperture 87 which is formed in one of the bridge pieces of the beam 96 between spaced coaxial cylindrical portions of that bridge piece. The control rod 97 is enlarged below that aperture 87 so that its enlarged lower end 88 engages the underside of the cylindrical surfaces of the spaced pair of cylindrical portions of the respective bridge piece and cannot pass through that aperture 87. FIG. 5 shows that the aperture 87 has a convexly curved arcuate surface.

A washer 89 slides on the control rod 97 above the beam 96. A circlip 91 is fitted into an annular groove 92 which is formed in the control rod 97 above the washer 89 and below that part of the rod 97 that slides within the bore 99. A coil spring 93 reacts against the circlip 91 and urges the washer 89 against the cylindrical surfaces of the spaced pair of cylindrical portions of the respective bridge piece of the beam 96, the reaction to the spring load urging the control rod 97 upwards towards the edge portion 56C of the lever 56. Hence the control beam 96 and the control rod 97 are pivotally connected, the spaced pair of cylindrical bridge piece portions together serving as the pivot pin.

The shoulder 94 formed between the smaller and larger diameter bore portions of the bore of the tubular body 83 serves as a valve seat for a needle valve 95 which slides within the bore of a tubular plug 101 which closes the larger diameter end portion of the bore of the tubular body 83. The needle valve 96 has an annular groove 102 formed in it between the shoulder 94 and the plug 101. A circlip 103 is fitted into the groove 102. A coil spring 104 reacts against the shoulder 94 and acts upon the circlip 103 to urge the needle valve 95 into contact with the other bridge piece of the control beam 96, that other bridge piece being flat. A hole 105 in the tubular body 83 places the bore portion between the shoulder 94 and the plug 101 in communication with the chamber 68.

When the engine is cold and not running, the temperature sensitive capsule 61 allows the actuator rod 64 to be held by the respective coil spring 65 in a position in which its annular flange is near to the capsule 61. The actual distance between the capsule 61 and the flange 66 is dependent on the temperature of the engine, the lower that temperature the smaller is that distance. Thus, due to the interengagement of the third peg 60 and the annular flange 66, the lever 56 is held against the action of the torsion spring 56D and locates the first peg 58 above the closure plate 21 by a distance which depends upon the temperature of the engine, the torsion spring 56D being strained. The colder the engine the greater is the spacing between the first peg 58 and the plate 21. The arm 54 that links the plug valve support rod 26 and the fuel metering needle cylindrical support member 51 is held by the respective coil spring 55 so that the lower edge of the recess in the depending plate 67 is in contact with the first peg 58. Thus the plug valve 24 is spaced from the orifice 25 that is formed at the junction of the chamber 18 and the downstream portion 19 of the air supply passage 17. The second peg 59 is spaced from the underside of the plate 67 when the lower edge of the recess in the depending plate 67 is in contact with the first peg 58. Whether or not the distance between the first peg 58 and the upper edge of the recess in the depending plate 67 is less than the distance between the second peg 59 and the lower edge of the plate 67 depends upon the temperature of the engine as has been explained above. The airvalve 29 is seated upon the associated valve seat 30 by the action of the respective coil spring 35. The diaphragm 71 is held in abutment with the opposite wall of the fuel chamber 69 by the action of the main spring 98. The needle valve 95 is held against the control beam 96 by the coil spring 104 so that it is unseated thereby leaving open the smaller diameter end portion of the bore of the tubular body 83 which serves as a suction port. The upper end of the control rod 97 is spaced from the edge portion 56C of the lever 56.

When the engine is cranked for starting, the plug valve 24, the fuel metering needle 52, the air valve 29 and its guide stem 31, the lever 56 and the control rod 97 remain substantially in the positions as just described. Suction exerted by the engine causes air to be drawn into the chamber 18 between the air valve 29 and its stem 31. Also fuel is drawn in metered quantities through the fuel passage. Such fuel is drawn through the fuel metering orifice 48 at a high rate because the profiled needle 52 is withdrawn and the effective area of the fuel metering orifice 48 is at its greatest. In addition air is withdrawn from the chamber 68 via the hole 105 and through the suction port. At the same time there is a restricted air bleed into the chamber 68 through an annular air passage of restricted dimensions, which is formed around the control rod 97 within the bore 99, so that any change in the pressure in the chamber 68 and thus in the blind bore 34 is insignificant.

The suction exerted by the engine increases when the engine begins to run under its own power. Consequently the air valve 29 is unseated, due to the combination of the action of the increased depression in the induction manifold 10 upon the end of the guide stem 31 remote from the air valve 29 and the action of the increased depression in the chamber 18 upon the air valve itself. The cross-sectional area of the guide stem 31, the effective area of the air valve 29 which is exposed to the depression that is established in the chamber 18, and the loading of the coil spring 35 are selected so that the depression that is established within the chamber 18 is a function of the inverse of the depression that is established in the induction manifold 10 when the engine is running.

The plug valve 24 is urged towards its associated orifice 25 in the air supply passage 17 until either the upper edge of the recess in the depending plate 67 abuts the first peg 58 or the bottom edge of that plate 67 abuts the second peg 59 which prevents further movement of the plug valve 24 towards its associated orifice 25 and movement of the fuel metering needle 52 with it. Whether the first peg 58 is abutted by the upper edge of the recess in the depending plate 67 or the second peg 59 is abutted by the bottom edge of the depending plate 67 depends upon just how cold the engine is when it begins to run under its own power. The upper edge of the recess in the depending plate 67 will abut the first peg 58 as shown in FIG. 3 if the engine is very cold whereas the bottom edge of that plate 67 will abut the second peg 59 if the temperature of the engine, whilst being less than the normal operating temperature of the engine, is greater than that at which the vertical distance between the two pegs 58 and 59 equals the height of the recess in the depending plate 67.

As the suction exerted by the engine increases when the engine begins to run under its own power, so does the air flow from the chamber 68 through the suction port. The difference between that air flow out of the chamber 68 and the restricted air bleed into the chamber 68 is such that a depression is established in the chamber 68, the depression being sufficient to displace the diaphragm 71 against the action of the main spring 98. Such movement of the diaphragm 71 enlarges the volume of the fuel chamber 69 and draws fuel into the fuel chamber 69 from the fuel passage upstream of the fuel metering orifice 48 via the conduit 50. The control beam 96 is raised by such movement of the diaphragm 71. Initially, for the major part of the rising movement of the diaphragm 71, the beam 96 pivots about the bottom of the needle valve 95 which is held unseated by its coil spring 104. Such pivotal movement of the beam 96 continues until the upper end of the control rod 97 abuts the edge portion 56C of the lever 56 as is shown in FIG. 3. Then the beam 96 pivots about the enlarged lower end 88 of the control rod 97 so that the needle valve 95 is urged towards its seat 94. The diaphragm 71 stops moving upwards to enlarge the volume of the fuel chamber 69 when the needle valve 95 is moved close enough to the suction port to restrict air flow through the suction port to an amount which equals the restricted air bleed into the chamber 68. The configuration of the fuel pump 14 is such that the amount the needle valve 95 moves from the location it adopts when the diaphragm 71 abuts the opposite wall of the fuel chamber 69 to the location in which it restricts air flow through the suction port to the amount equal to the restricted air bleed into the chamber 68 is small compared with the distance moved by the control rod 97 into abutment with the edge portion 56C of the lever 56 when the engine is cold.

As the temperature of the engine increases, the temperature sensitive capsule 61 urges the actuator rod 64 against the action of the respective coil spring 65 thus allowing the lever 56 to be rotated by the action of the torsion spring 56D in the direction which moves the first peg 58 and the second peg 59 towards the body 16. Hence, either the gap between the edge portion 56C of the lever 56 and the control rod 97 is reduced so that the amount of upwards movement of the control rod 97 before it abuts the lever 56, and thus the amount of upwards movement of the diaphragm 71 is less than it would have been if such movement of the lever 56 had not occurred, or, if the control rod 97 is already touching the lever 56, the control rod 97 is moved towards the diaphragm 71.

If idling conditions are maintained until the engine warms up to its normal operating temperature, such movement of the first peg 58 and the second peg 59 towards the body 16 allows the arm 54 that links the plug valve support rod 26 and the fuel metering needle cylindrical support member 51 and the plate 67 that depends from that arm 54 to follow them due to the action of the engine suction on the plug valve 24. If the upper edge of the recess in the depending plate 67 is initially in abutment with the first peg 58 it will remain in abutment with that peg 58 until angular movement of the lever 56 is such that the bottom edge of the depending plate 67 moves into abutment with the second peg 59 as well whereafter the bottom edge of the depending plate 67 remains held in abutment with the second peg 59 whilst the first peg 58 moves away from the upper edge of the recess in that plate 67, otherwise the bottom edge of the depending plate 67 always follows the second peg 59. The plug valve 24 is moved to reduce the effective area of the associated orifice 25 and the air supply passage 17 and thus to reduce the mass flow of air through the air supply passage 17, and the profiled needle 52 is moved with it to reduce the effective area of the fuel metering orifice 48.

If the control rod 97 is moved towards the diaphragm 71 with rotation of the lever 56 in the direction which moves the first peg 58 and the second peg 59 towards the body 16, the control beam 96 is fulcrummed about its lobes which abut the disc 78. As a result, the needle valve 95 is urged towards its seat 94 and air flow out of the chamber 68 is further restricted to an amount which is less than the restricted air bleed into the chamber 68. Hence the depression in the chamber 68 tends to fall and that causes movement of the diaphragm 71 to reduce the volume of the fuel chamber 69 and enlarge the volume of the chamber 68. The beam 96 follows such movement of the diaphragm 71, due to the action of the coil spring 104 on the needle valve 95, until the needle valve 95 is restored to the location relative to its seat in which it restricts air flow through the suction port to an amount which equals the air bleed into the chamber 68, and thereby prevents further movement of the diaphragm 71 to reduce the volume of the fuel chamber 69 because the depression in the chamber 68 no longer tends to fall. Liquid fuel displaced from the fuel chamber 69 by such movement of the diaphragm 71 to reduce the volume of the fuel chamber with increasing engine temperature is negligible in quantity and becomes part of the metered fuel flow through the fuel passage of the cold start device 15 so that it has a negligible effect upon the volume of the air/fuel mixture drawn from the cold start device 15 by operation of the engine as well as a negligible effect upon the ratio of air to fuel in such a mixture.

Such movement of the plug valve 24 towards or into its associated orifice 25 and, once the suction port shut-off valve 95 has assumed the location in which it restricts air flow through the suction port to an amount which equals the air bleed into the chamber 68, such movement of the diaphragm 71 to reduce the volume of the fuel chamber 69 with movement of the actuator rod 64 against the action of the coil spring 65 continues as the temperature of the engine increases towards the normal working temperature. The diaphragm 71 abuts the opposed wall of the fuel chamber 69 (see FIG. 5) as the temperature of the engine approaches the normal working temperature, and is held there by the main spring 98. Further pivotal movement of the lever 56 towards the body 16 with further increase in the temperature of the engine causes the control beam 96 to pivot about its lobes and move the needle valve 95 towards its seat 94. Hence the needle valve 95 is seated to shut off the suction port and is held so seated by the coil spring 93 which yields to allow movement of the control rod 97 relative to the beam 96. The orifice 25 in the air supply passage 17 is closed by the plate valve 28 once the suction port shut-off valve 95 is seated and just before the normal working temperature of the engine is reached. The final pivotal movement of the lever 56 towards the body 16 as normal engine working temperature conditions are established moves the sealing ring 53 into engagement with the tapered shoulder formed between the fuel metering orifice 48 and the adjacent end bore portion 47 to close the fuel passage.

The rate of flow of fuel through the fuel metering orifice 48 is dependent upon the effective area of the fuel metering orifice 48 and thus is altered in accordance with changes in engine temperature by the profiled needle 52 which is allowed to move with changes in engine temperature. Likewise, the rate of flow of fuel/air mixture through the orifice 25 associated with the plug valve 24 is altered in accordance with changes in engine temperature by the profiled plug valve 24 which is allowed to move with changes in engine temperature. Conveniently, the profile of the plug valve 24 is selected so that the idling speed of the engine is maintained constant or at any desired level throughout the period required for the engine to warm up to its normal operating temperature.

The depression in the induction manifold 10 is high and the walls of the manifold are dry during idling conditions. That depression falls if the carburetter throttle valve 13 is opened to accelerate the vehicle and such a fall in manifold depression is accompanied by wetting of the walls of the manifold 10 with fuel. If, before the engine has warmed up to its normal working temperature, that reduction in manifold depression is sufficient to reduce the force that engine suction exerts upon the plug valve 24 to a force which is less than the opposing force exerted by the coil spring 55, the plug valve 24 and the fuel metering needle 52 are moved to increase the effective area of the orifices with which they are associated. Such movement of the plug valve 24 and the fuel metering needle 52 is limited by engagement of the lower edge of the recess in the depending plate 67 with the first peg 58. If the carburetter 12 is a fixed choke carburetter, the depression in the induction passage 10 falls to a negligible level when the driver operable throttle valve 13 is opened fully to accelerate the engine.

A reduction in the depression established in the induction manifold 10 before the engine has warmed up to its normal operating temperature is accompanied also by movement of the air valve 29 towards its valve seat 30, due to the action of the coil spring 35 and because of both the reduction in the counterload exerted upon the cylindrical stem 31 by the depression in the manifold 10 and the initial tendency for the depression in the chamber 18 to diminish. Such movement of the air valve 29 towards its seat 30 is followed by an increase in the depression in the chamber 18. Consequently the ratio of fuel to air that is drawn through the orifice 25 that is associated with the plug valve 24 is increased by the combined effects of the reduction in the effective area of the aperture 22 and the increase in the depression in the chamber 18. Thus the increase in the quantity of fuel required by the engine for acceleration is achieved by automatic operation of the cold start device 15 once steady state acceleration conditions are established but the amount of fuel drawn from the fuel passage of the cold start device 15 is insufficient to compensate for the fuel that wets the walls of the manifold 10 so that the higher, transient air and fuel requirements of the engine necessary when the engine is first accelerated from idling are not met by automatic operation of the cold start device 15 alone. Also, where the carburetter 12 is a fixed choke carburetter, the depression in the induction passage 10 will decay to such an extent that the corresponding increase in the depression in the chamber 18 of the air supply passage 17 cannot be maintained, if the driver operable throttle valve 13 is held open for more than the initial time interval, so that it decays as well with a consequent reduction in the quantity of fuel that is drawn into the air supply passage 17 from the fuel passage. However, the depression in the other chamber 68 of the fuel pump 14 will also have fallen, either because the suction port shut-off valve 95 had not reached the location in which it restricts air flow through the suction port to the amount equal to the restricted air bleed into the chamber 68 when the depression in the manifold 10 fell or because the fall in the manifold depression resulted in the depression in the pipe 85 falling below that in the chamber 68 when the needle valve 95 was so located so that the flow of air from the chamber 68 through the suction port was less than the air bleed into the chamber 68. Hence the volume of the fuel chamber 69 is reduced by movement of the diaphragm 71 due to expansion of the main spring 98 and fuel is displaced from the fuel chamber 69 through the conduit 50 and the fuel passage of the device 15 to the chamber 18 of the air supply passage 17. The fuel displaced from the fuel chamber 69 in this way will compensate for the fuel that wets the walls of the manifold 10 so that the air/fuel requirements of the engine for the remainder of the transient acceleration conditions that prevail can be met by operation of the carburetter 10 and the cold start device 15. The beam 96 and the control rod 97 will follow such movement of the diaphragm 71 so that the control rod 97 separates from the edge portion 56C of the lever 56. The gap between the upper end of the control rod 97 and the edge portion 56C when the fuel chamber 69 is emptied will be dependent upon the temperature of the engine at that time. The depression that will act upon the diaphragm 71 when such steady state conditions are established will withdraw the diaphragm 71 against the action of the main spring 98 until the movement of the control beam 96, the control rod 97 and the needle valve 95 that follows such movement of the diaphragm 71 allows the needle valve 95 to reassume the location in which it restricts air flow through the suction port to the amount equal to the restricted air bleed into the chamber 68. The amount of movement of the control beam 96 necessary to so relocate the needle valve 95 reduces as the temperature of the engine increases, because the gap between the edge portion 56C of the lever 56 and the upper end of the control rod 97 when the fuel chamber 69 is empty reduces with increasing engine temperature. Hence the quantity of fuel that is drawn into the fuel chamber 69 when such steady state conditions are re-established diminishes as the temperature of the engine increases with a consequent reduction in the amount of fuel available to be pumped from the fuel chamber 69 into the chamber 18 of the air supply passage 17 via the fuel passage and the fuel metering orifice 48 if the driver operable throttle valve 13 is opened fully to accelerate the engine before it has reached its normal working temperature.

The chamber 68 of the fuel pump 14 serves as a reference pressure chamber which is separated from the fuel chamber 69 by a movable wall which comprises the diaphragm 71. The depression that is established within the chamber 68 is derived from the depression in the manifold 10 but is limited by the action of the suction port shut-off valve to that depression which, by virtue of its action on the diaphragm 71, so locates the suction port shut-off valve 95 in relation to the suction port so as to restrict air flow from the chamber 68 through the suction port to an amount which equals the air bleed into the chamber 68. Moreover the shut-off valve 95 seats to positively shut-off the chamber 68 from the manifold 10 when the engine reaches its normal operating temperature so that, due to the air bleed, atmospheric pressure conditions are established in the chamber 68 when the engine is at its normal working temperature. Hence the movable wall is protected by the suction port shut-off valve 95 from any higher depressions that may be established within the manifold 10, such as under engine overrun conditions when the engine is acting as a brake, any such higher depression increasing the forces that act to seat the suction port shut-off valve 95 once that valve is seated. Provision of the air bleed into the chamber 68 enables the volume of the fuel pump fuel chamber 69 to be reduced with increasing engine temperature without a mechanical stop for the movable wall being used. Hence the danger of the diaphragm being punctured or strained is minimised by the provision of the suction port shut-off valve and the air bleed.

That portion of the blind bore 34 that extends between its closed end wall and the stem 31 may be connected to the other chamber 68 of the fuel pump 14 by a suitable passage in the body 16 instead of being connected directly to the induction passage 11 of the carburetter 12 by the short pipe 39. The operation of an engine installation including such a modification is described by the description filed with our British Patent Application No. 79 02261 dated 22 Jan. 1979.

The suction port shut off valve may be a ball valve instead of the needle valve 95. Such a ball valve may be housed within the cavity of a hollow body formed at the respective end of the control beam. The hollow body may embrace the part of the body 16 in which the suction port is formed, in which case it would be provided with suitable apertures which place the reference pressure chamber 68 in communication with its interior. The ball valve may be spring loaded towards the suction port by a spring which reacts against the base of the cavity of the hollow body, the hollow body itself being spring loaded in the opposite direction by another spring which reacts against the body 16.

The control rod 97 may be arranged to simply rest upon the control beam rather than being pivotally connected to it.

There may be an air port in the reference pressure chamber instead of or in addition to the restricted air passage formed by the bore 99 and the control rod 97, the air port being connected to the surrounding atmosphere, and a shut-off valve for the air port which is biassed closed and which is linked to the control rod so that it can be unseated to open the air port and effect a controlled introduction of air into the reference pressure chamber by movement of the control rod which follows an increase in the temperature of the engine, the air port shut-off valve being associated with the diaphragm such that it is adapted to be moved in the closing direction by movement of the diaphragm towards the location it adopts when stable pressure conditions are re-established within the reference pressure chamber. The air port shut-off valve may be linked to the control rod in such a way that it cannot be opened unless the suction port shut-off valve is closed. Conveniently the air port is formed substantially coaxially with the suction port, the two ports being formed in a laterally extending portion of the reference pressure chamber 68. The two valves may be housed in a cage carried by the control beam and there may be resilient means in the cage to urge the two valves apart. The cage may be arranged such that the two valves are seated by the action of the resilient means within it when it is located in a median position.

Figure 6:
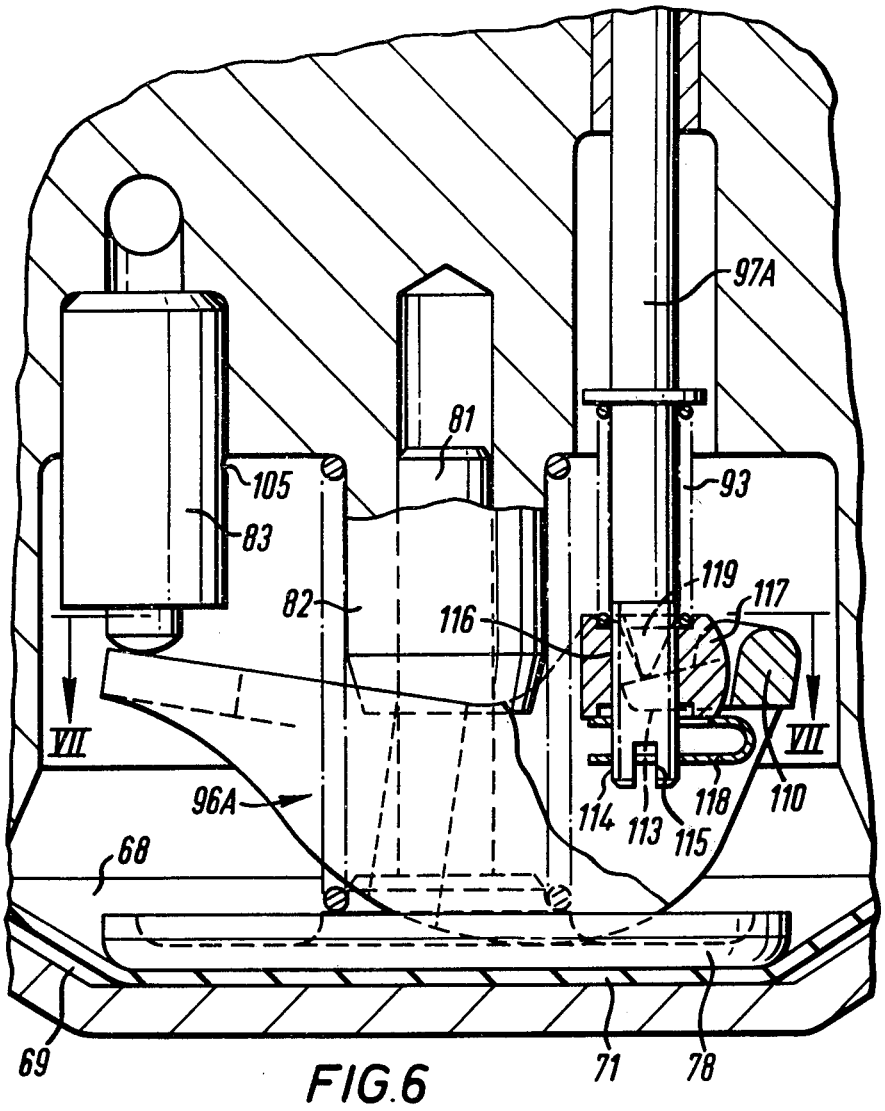
FIG. 6 is a view similar to part of FIG. 5 illustrating a modification of the arrangement shown in FIG. 5.
Figure 7:
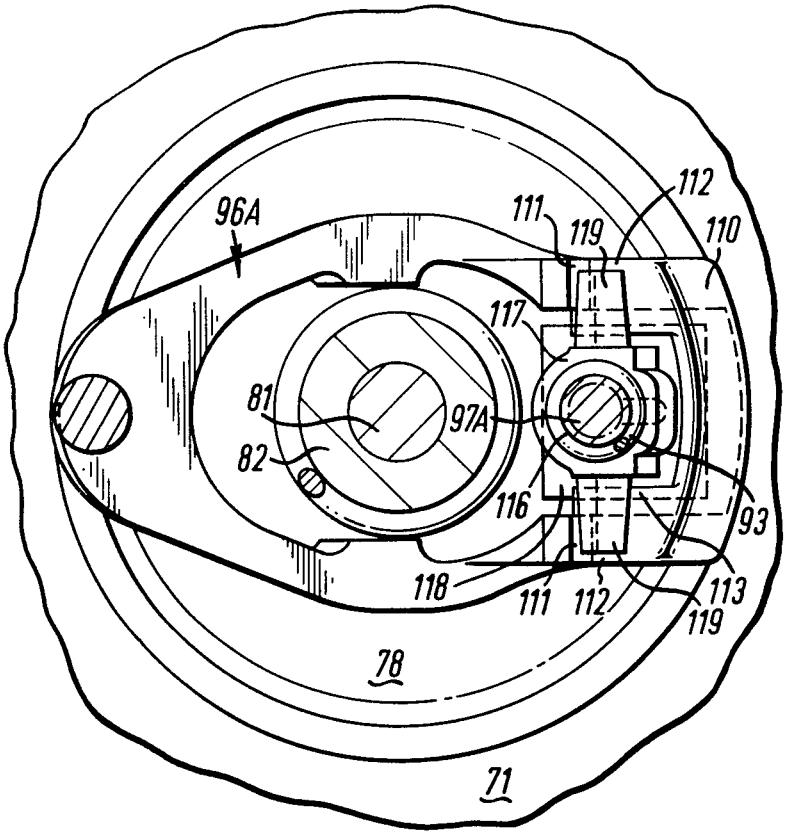
FIG. 7 is a section on the line VII—VII in FIG. 6.
Figure 8:
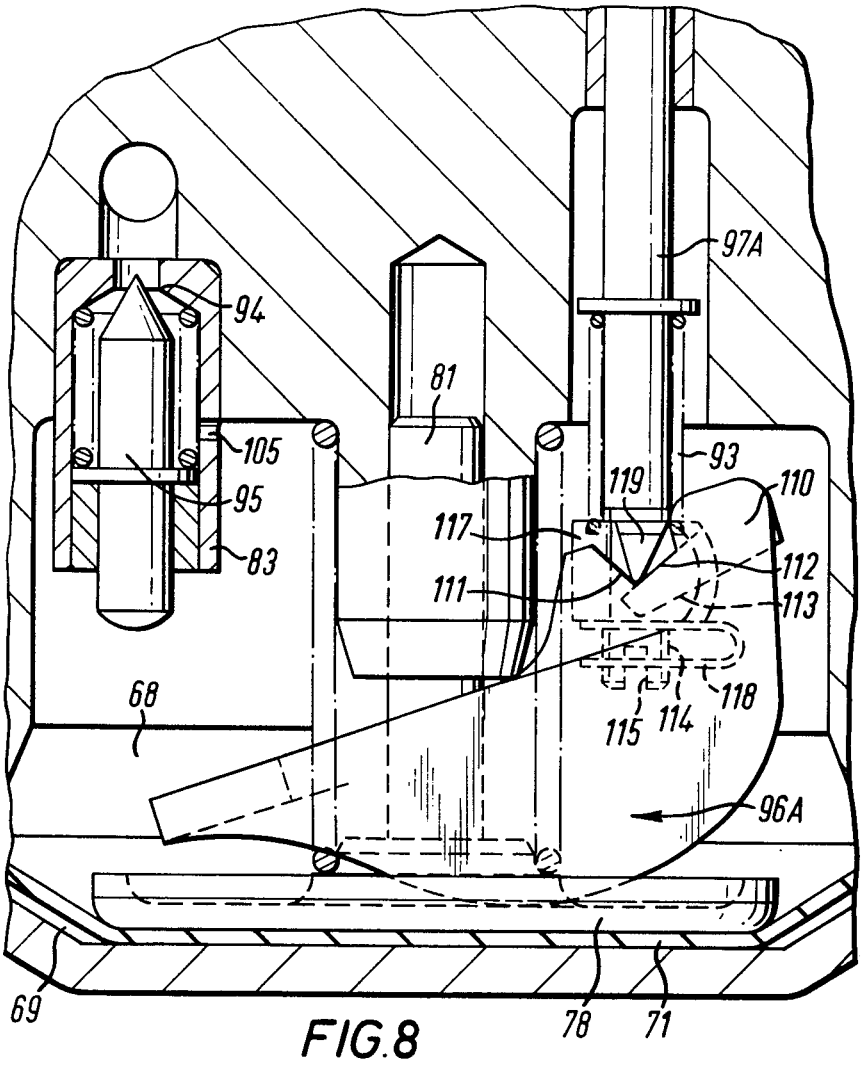
FIG. 8 is a view in elevation of the parts shown in FIG. 6 in the positions they adopt when the engine is cold.

FIGS. 6 to 8 shown another form of pivotal connection between the control beam and the control rod which is less vulnerable to friction in operation than is the pivotal connection described above with reference to FIG. 5.

Both the control beam 96A and the control rod 97A shown in FIGS. 6 to 8 are modified forms of the corresponding components 96 and 97 of the fuel pump described above with reference to FIG. 5. The following description is concerned with those modifications.

The portion of the control beam 96A which incorporates the important modifications is that portion which is located on the side of the stem 81 remote from the flat bridge piece against which the needle valve 95 is urged. The bridge piece 110 of the modified control beam portion is bowed, presenting its concave face to the stem 81. It has an arcuate upper surface and a flat lower surface.

Each bowed limb of the control beam 96A has a notch formed in its upper surface, the surface 111 of each notch that is further from the bowed bridge piece 110 being inclined more steeply than the other surface 112 of that notch which slopes up to the bowed bridge piece 110. The notches are equi-spaced from the bowed bridge piece. A shelf 113 is formed on the inner surface of each bowed limb of the control beam 96A, with its upper surface coplanar with the shallow notch surface 112. Each shelf 113 extends from the bowed bridge piece 110 just past the respective notch.

The lower end portion 114 of the control rod 97A, which is screw threaded and has a screwdriver slot formed in it at the bottom, extends through a through bore 116 formed in a body 117. The through bore 116 is rebated at either end. The lower end turn of the coil spring 93 seats in the upper rebated end portion of the through bore 116 and urges the body 117 onto a special self-locking nut 118 which is fitted onto the screwthreaded lower control rod end portion 114 below the body 117. The special nut 118 is formed from sheet material bent up into a U-shape. An aligned pair of holes are formed in the limbs of the U-shaped component and the lower control rod end portion 114 is screwed into those holes. The limbs of the U-shaped component were held deflected from the relative locations to which they are urged by the inherent resilience of the component, so that they were spaced further apart than they are when in the natural condition of the component, whilst the lower control rod end portion 114 was screwed into their holes. Hence the nut 118 is locked frictionally against displacement relative to the control rod 97A by the action of its own resilience which urges its two limbs towards one another and thus against the respective threads of the lower control rod end portion 114. The special nut 118 is rectangular in plan and its width is a little less than the width of the space between the bowed limbs of the control beam 96A within which it is located. The bowed limbs stop the nut 118 from rotating whilst the control rod 97A is screwed into it during assembly. The nut 118 extends below the two shelves 113 which serves as stops to limit movement of the control rod 97A and the body 117 upwards relative to the control lever 96A.

The body 117 has an aligned pair of V-shaped trunnions 119 which project one from either of its sides. Each trunnion 119 has a radiused apex which rests in the manner of a knife edge in a respective one of the two notches that are formed by the bowed limbs of the control beam 96A. The orientation of each trunnion 119 on the body 117 is such that the angles included between the axis of the control rod 97A and each of the planar side faces of each trunnion 119 are different, the smaller of the two angles for each trunnion 119 being that which is included between the axis of the control rod 97A and the one of its two planar side faces that faces the surface 111 of the respective notch. The surface of that part of the body 117 that extends between the trunnions 119 and that faces the bowed bridge piece 110 is formed with a compound convex curvature such that there is a small gap between it and the bowed bridge piece 110 throughout the range of location of the control beam 96A relative to the control rod 97A. The bowed bridge piece 110 and the part of the bowed limbs that form the surfaces 111 serve as stops that inhibit movement of the body 117 towards the respective one of the two bridge pieces of the control beam 96A.

I claim:

1. A fuel pump for incorporation in an i.c. engine air/fuel induction system which includes a carburetter having a driver operable throttle valve as well, the fuel pump comprising a hollow casing, a movable wall which divides the interior of the hollow casing into an air chamber and a fuel chamber which is for connection to a source of liquid fuel and the air/fuel induction system, resilient means which urge the movable wall to minimise the volume of the fuel chamber and thermostatically controlled means which are adapted to be responsive to the temperature of the engine to which the fuel pump is fitted when used, wherein the improvement comprises the provision of pressure regulating means for regulating a depression in said air chamber in accordance with a function of the depression that is established in the inlet manifold of the engine to which the pump is fitted when used and to the temperature of that engine, the pressure regulating means including a valve which is operatively associated with said thermostatically controlled means and which is adapted to be urged to restrict communication between the air chamber and the inlet manifold of the engine in response to a tendency for the depression in said air chamber to exceed a predetermined maximum when said predetermined maximum depression acts within the air chamber and the depression in the inlet manifold of the engine is at or above said predetermined maximum whilst, at least when the temperature of the engine is less than the normal working temperature, permitting relatively free communication between the air chamber and the inlet manifold of the engine when the depression in the inlet manifold of the engine is less than said predetermined maximum, the thermostatically controlled means co-operating with the valve and with an air bleed into the air chamber such that the volume of the air chamber, when communication between the air chamber and the inlet manifold is restricted, increases as the temperature of the engine increases.

2. A fuel pump according to claim 1, wherein the valve is adapted to be seated by the thermostatically controlled means to shut off communication between the air chamber and the inlet manifold of the engine when the engine has warmed up to its normal working temperature.

3. A fuel pump according to claim 1, wherein the pressure regulating means comprise a suction port in the air chamber, the suction port being for connection to the inlet manifold of the engine to which the pump is fitted when used; means for providing a regulated air flow into the air chamber from a separate source which is at a pressure which is higher than that in the air chamber, the regulated air flow comprising said air bleed, and a control member which extends movably through a wall portion of the casing into the air chamber and which is adapted to be linked to said thermostatically controlled means which are operable to move the control member relative to the casing when the temperature of the engine changes so that the location of the control member relative to the casing is dependent upon the temperature of the engine; said valve comprising a shut-off valve for the suction port, said valve being resiliently biassed open and co-operating with a control beam which is pivotally connected to the control member and which has a portion which co-operates with the movable wall so that it follows movement of the movable wall, the suction port shut-off valve and the control beam being orientated with respect to the movable wall and the suction port such that the suction port shut-off valve is moved in the closing direction by movement of the control beam that follows movement of said movable wall to enlarge the volume of the fuel chamber; and the forces that act upon the suction port shut-off valve to tend to seat it when the pump is in use, once it is located adjacent the suction port to restrict flow through the suction port and limit further increase in the volume of the fuel chamber, comprising a reaction applied to it from the control beam and the action upon it of the depression in the suction port and the forces tending to move it away from the suction port comprising the biassing load by which it is biassed open and the action upon it of the depression that is established within the air chamber.

4. A fuel pump according to claim 3 wherein the means for providing a regulated air flow into the air chamber provide such an air flow continuously.

5. A fuel pump according to claim 4, wherein the means for providing a continuous regulated air flow into the air chamber comprise a passage of restricted dimensions which is formed in the casing and by which the air chamber is placed in restricted communication with the surrounding atmosphere which comprises said separate source of air.

6. A fuel pump according to claim 5, wherein the restricted passage comprises the clearance between the control member and a bore in said casing wall portion within which that control member is a sliding fit.

7. A fuel pump according to claim 3, wherein said suction port shut-off valve is a needle valve which is urged into abutment with the control beam by a coil spring which reacts against the casing around the suction port and serves as the biassing means by which said valve is biassed open.

8. A fuel pump according to claim 3, wherein the control beam portion that co-operates with the movable wall comprises a lobe which abuts the movable wall and which is profiled so that it maintains contact with the movable wall during rocking movement of the control beam relative to the movable wall.

9. A fuel pump according to claim 8, wherein the control beam has two such lobes each formed by a respective one of two bowed limbs which extend on either side of said resilient means, the bowed limbs being joined together by bridge pieces adjacent their ends on either side of said resilient means.

10. A fuel pump according to claim 9, wherein said suction port shut-off valve is a needle valve which is urged into abutment with the control beam by a coil spring which reacts against the casing around the suction port and serves as the biassing means by which said valve is biassed open, the pivotal connection between the control member and the control beam is adjacent to one of the bridge pieces and the needle valve is urged into abutment with the other bridge piece which is flat.

11. A fuel pump according to claim 3, wherein the pivotal connection between the control member and the control beam comprises at least one substantially V-shaped part which is carried by the control member and which is engaged in the manner of a knife edge in a corresponding notch formed in the control beam.

12. A fuel pump according to claim 11, in which the control beam portion that co-operates with the movable wall comprises two lobes, each lobe being formed by a respective one of two bowed limbs which extend one on either side of said resilient means, the bowed limbs being joined together by bridge pieces adjacent their ends on either side of said resilient means, and the lobes abutting the movable wall and being profiled so that they maintain contact with the movable wall during rocking movement of the control beam relative to the movable wall, wherein said at least one substantially V-shaped part is one of two such V-shaped parts which are carried by the control member in the manner of trunnions and which each rest in a respective notch which is formed by a respective one of the bowed limbs.

13. A fuel pump according to claim 12, wherein the V-shaped parts are formed by a body which has a through bore through which the control member extends, the body being urged onto a stop carried below it by the control member and being so urged by resilient means which react against an abutment carried above it by the control member.

14. A fuel pump according to claim 13, wherein the stop comprises a self-locking nut fitted onto the control member.

15. A fuel pump according to claim 14, wherein the self-locking nut comprises a U-shaped component bent up from sheet material with an aligned pair of holes formed in each of its two sheet material limbs, the control member having a screw-threaded portion which is screwed into the aligned pair of holes and the limbs being deflected from the relative locations to which they are urged by the inherent resilience of the component.

16. A fuel pump according to claim 1, wherein the movable wall comprises a diaphragm of flexible impervious material.

17. A fuel pump according to claim 16, wherein at least that part of the diaphragm that extends across the interior of the hollow casing to separate the air chamber from the fuel chamber is a non-apertured sheet of the flexible impervious material.

18. A fuel pump according to claim 17 in which the control beam portion that co-operates with the movable wall comprises two lobes, each lobe being formed by a respective one of two bowed limbs which extend one on either side of said resilient means, the bowed limbs being joined together by bridge pieces adjacent their ends on either side of said resilient means, and the lobes abutting the movable wall and being profiled so that they maintain contact with the movable wall during rocking movement of the control beam relative to the movable wall, wherein the movable wall includes a disc which is within the air chamber, which is urged against the diaphragm by the resilient means and which is abutted by the or each bowed limb of the control beam.

19. A fuel pump according to claim 16, wherein a major part of the diaphragm, including its central portion, is adapted to seat upon the opposed wall of the fuel chamber so that the volume of that fuel chamber is negligible when it is minimised.

20. A fuel pump according to claim 1, wherein the fuel chamber has a single port through which fuel is both drawn into the fuel chamber and discharged from the fuel chamber.

21. A fuel pump according to claim 20, wherein the fuel chamber port is in communication with a conduit length of flow restricting dimensions.

22. A fuel pump according to claim 1, in combination with a cold start fuel/air mixture supply device, the cold start fuel/air mixture supply device comprising an air supply passage which has one end for connection to the inlet manifold of the internal combustion engine so that air can be drawn through that passage by engine suction when the device is fitted to the engine, an automatically operable throttle valve in the air supply passage, the automatically operable throttle valve being adapted to co-operate with an orifice which is formed within the air supply passage in order to throttle fluid flow through that orifice and being arranged to be urged to reduce the effective area of the orifice by engine suction when the device is fitted to the engine and the engine is running under its own power, a fuel passage which terminates in a fuel discharge nozzle which is formed in the air supply passage upstream of the orifice, the fuel passage including fuel metering means for metering flow of fuel drawn through the fuel passage from a source of liquid fuel by a depression which is established within part of the air supply passage upstream of the orifice, and thermostatically controlled means comprising a movable stop for limiting movement of the automatically operable throttle valve in the direction in which it is moved to reduce the effective area of the orifice, the position of the stop being controlled automatically in relation to the temperature of the engine to which the cold start fuel/air mixture device is fitted when used by control means which are responsive to the temperature of the engine in use so that the stop is moved to allow following movement of the automatically operable throttle valve in said direction as the engine warms up towards its normal working temperature whereat movement of said automatically operable throttle valve to close the orifice is permitted, whereby, when the device is fitted to the engine the constitution of the air/fuel mixture drawn from the device by the engine is changed firstly at the end of the engine cranking period, when the engine begins to run under its own power, and, when the engine has started to run under its own power, both the air flow in the air supply passage and the flow of fuel into the air supply passage through the fuel passage are decreased progressively with increase in engine temperature, the fuel pump being arranged so that fuel is displaced from the fuel chamber into the air/fuel induction system when the depression established in the inlet manifold of the engine is at or below the predetermined maximum and that depression falls and fuel is drawn into the fuel chamber from said source when the depression established in the inlet manifold of the engine increases up to said predetermined maximum.

23. A combination of a fuel pump and a cold start fuel/air mixture supply device according to claim 22, wherein the cold start fuel/air mixture supply device includes an air valve which co-operates with a valve seat to vary the area of part of the air supply passage upstream of the orifice and thereby controls the depression that is established within that portion of the air supply passage between the orifice and the valve seat, which is the portion of the air supply passage in which the fuel discharge nozzle is formed, and that serves as the fuel demand signal that draws fuel into the passage from the source of liquid fuel, and yieldable biassing means for urging the air valve towards the valve seat against the action upon the air valve of any such depression which is established within the air supply passage between the valve seat and the orifice and which tends to unseat the air valve.

24. A combination of a fuel pump and a cold start fuel/air mixture supply device according to claim 23, wherein the air valve carries a part which has a surface which is exposed to the pressure that is existent in a space which is for connection to a suitable source of suction, the part and the space being orientated with reference to the yieldable biassing means and said air valve seat so that, when the device is fitted to the engine in use, the biassing effect of said yieldable biassing means upon said air valve is opposed by the thrust due to the action on said surface of suction from said source, the arrangement being such that the effective cross-sectional area of said part of the air supply passage is dependent upon the depression that is established within the air supply passage between the orifice and the valve seat, upon the biassing effect exerted upon the air valve by the yieldable biassing means and upon the opposing thrust exerted upon the air valve due to the action on said surface of suction from said source.

25. A combination of a fuel pump and a cold start fuel/air mixture supply device according to claim 22, wherein the fuel chamber is connected to the fuel passage of the cold start fuel/air mixture supply device upstream of the fuel metering means so that it is adapted to be connected to the same source of liquid fuel as is that fuel passage and so that fuel displaced from the fuel chamber is fed into the air/fuel induction system through the fuel metering means of the cold start fuel/air mixture supply device.

26. A combination of a fuel pump and a cold start fuel/air mixture supply device according to claim 22, wherein the fuel pump is adapted to be rendered inoperative to pump liquid fuel into the air/fuel induction system when the engine with which the combination is used has warmed up to the temperature at which the cold start fuel/air mixture supply device ceases to supply extra fuel and air to the engine.

27. A combination of a fuel pump and a cold start fuel/air mixture supply device according to claim 22, wherein the fuel pump is adapted to continue to function to pump extra fuel into the air/fuel induction system of an engine with which the combination is used when the depression in the inlet manifold of that engine falls and the engine has warmed up to its normal working temperature.

28. A fuel pump for incorporation in an i.c. engine air/fuel induction system which includes a carburetter having a driver operable throttle valve as well; the fuel pump comprising a hollow casing, a diaphragm of flexible impervious material which divides the interior of the hollow casing into an air chamber and a fuel chamber, resilient means which urge the diaphragm to minimise the volume of the fuel chamber, the air chamber having a suction port which is for connection to the inlet manifold of the engine to which the pump is fitted when used, and a valve for the suction port which is resiliently biassed open and which co-operates with a control beam which has a portion which co-operates with the diaphragm so that the beam follows movement of the diaphragm, the suction port valve and the control beam being oriented with respect to the diaphragm and the suction port such that the suction port valve is urged towards the suction port by movement of the control beam that follows movement of said diaphragm to enlarge the volume of the fuel chamber, the arrangement being such that, once the suction port valve reaches a location relative to the suction port in which it restricts flow through the suction port so that the pressure in the air chamber is maintained substantially constant and further increase in the volume of the fuel chamber is prevented, the forces acting upon it to urge it towards the suction port comprise a reaction applied to it from the control beam and the action upon it of the depression in the suction port and the forces tending to move it away from the suction port comprise the biassing load by which it is biased open and the action upon it of the depression that is established within the reference pressure chamber.

* * * * *

UNITED STATES PATENT AND TRADEMARK OFFICE

CERTIFICATE OF CORRECTION

PATENT NO. : 4,255,362

DATED : March 10, 1981

INVENTOR(S) : GRAY E.D. ROSS

It is certified that error appears in the above-identified patent and that said Letters Patent are hereby corrected as shown below:

Column 1, please delete the first paragraph which reads as follows:

"This is a continuation of application Ser. No. 624,623 filed 10-22-75 now abandoned which in turn is a continuation of U.S. Ser. No. 367,291 filed June 5, 1973, now abandoned."

Signed and Sealed this

*Sixteenth* Day of *June 1981*

[SEAL]

*Attest:*

RENE D. TEGTMEYER

*Attesting Officer*

*Acting Commissioner of Patents and Trademarks*